United States Patent [19]

Arai

[11] Patent Number: 4,903,349

[45] Date of Patent: Feb. 27, 1990

[54] HELMET CHIN STRAP HAVING PRIMARY FASTENING DEVICE AND SECONDARY FASTENING DEVICE FOR FREE END OF STRAP

[76] Inventor: Michio Arai, 1-164 Horinouchi, Ohmiya-shi, Saitama-ken, Japan

[21] Appl. No.: 102,421

[22] Filed: Sep. 29, 1987

[30] Foreign Application Priority Data

Feb. 17, 1987 [JP] Japan ..... 62-35264

[51] Int. Cl.[4] ..... A42B 3/02; A42B 7/00

[52] U.S. Cl. ..... 2/421; 2/DIG. 6; 24/265 AL

[58] Field of Search ..... 2/417–429, 2/DIG. 6, 2, 410, 5, 6, 411, 415, 416, 208, 209, 209.1, 209.2, 196, 195, 183, 452, 161 A, 161 R, 24, 22; 24/265 AL, 31 V; 224/901, 250, 324, 209, 215, 176, 917; 297/DIG. 6; 128/77, 76 R, DIG. 6, DIG. 5; 36/50; 119/101, 102

[56] References Cited

U.S. PATENT DOCUMENTS

| | | | |
|---|---|---|---|
| 599,683 | 3/1898 | Capitain | 24/265 AL |
| 1,616,187 | 2/1927 | Hart | 2/6 |
| 1,903,081 | 3/1933 | Wotherspoon | 24/265 AL |
| 1,996,078 | 4/1935 | Manson | 2/6 |
| 3,513,482 | 5/1970 | Holden | 2/421 |
| 3,548,410 | 12/1970 | Parker | 2/424 |
| 4,017,907 | 4/1977 | Margolis | 2/158 |
| 4,056,852 | 11/1977 | Greendale | 2/417 |
| 4,075,714 | 2/1978 | Ryder et al. | 2/425 |
| 4,101,983 | 7/1978 | Deca et al. | 2/425 |
| 4,112,521 | 9/1978 | Uke | 2/428 |
| 4,222,122 | 9/1980 | Toms | 2/424 |
| 4,240,157 | 12/1980 | Peters | 2/161 R |
| 4,249,267 | 2/1981 | Voss | 2/69 |
| 4,347,630 | 9/1982 | Arai et al. | 2/421 |
| 4,528,700 | 7/1985 | Johnston | 2/DIG. 6 |
| 4,551,861 | 11/1985 | Marchello | 2/425 |
| 4,622,961 | 11/1986 | Christensen | 128/77 |
| 4,642,914 | 2/1987 | Caldeira | 36/50 |
| 4,686,712 | 8/1987 | Spiva | 2/421 |

FOREIGN PATENT DOCUMENTS

| | | | |
|---|---|---|---|
| 682644 | 5/1930 | France | 2/6 |

*Primary Examiner*—Harvey G. Hornsby
*Assistant Examiner*—Joseph S. Machuga
*Attorney, Agent, or Firm*—Klauber & Jackson

[57] ABSTRACT

A helmet with a chin strap to reliably secure it to a user's head. The chin strap is comprised of a retainer strap having a fastening member (e.g.: 'D'-ring) and an operational band intended to be tightly fastened through the fastening member of the retainer strap. The retainer strap is provided at its free end, typically above the fastening member, with either a male or female connector means (e.g.: "snap"), and the operational strap is provided at its free end with the mating connector means.

4 Claims, 2 Drawing Sheets

HELMET CHIN STRAP HAVING PRIMARY FASTENING DEVICE AND SECONDARY FASTENING DEVICE FOR FREE END OF STRAP

BACKGROUND OF THE INVENTION

1. Technical Field of the Invention

The present invention relates to a helmet, and more particularly to a helmet with a chin strap which is to be worn in driving a motorcycle, an automobile or the like.

2. Prior Art

A conventional chin strap of a helmet is constituted of a retaining strap mounted at its one end to one side portion of the helmet body and an operational strap mounted at its one end to the other side portion of the helmet body. The retainer strap is provided at a suitable position with a fastening member such as a couple of D-shaped or substantially rectangular fastening rings. The free end portion of the operational band is inserted through the fastening rings of the retainer strap, and is then folded about the outside (outward) fastening rings. Then, the operational band is passed between both rings, and is drawn through. Thus the chin strap is fastened to grip a user's jaw/throat and thereby secure the helmet to the user's head, so that the helmet may be prevented from being easily detached from the head even when receiving an impact.

However, the free end of the operational strap of the chin strip in the prior art, that is, the part of said strap that extends through/from the fastening member is not fixed in place. As a result, the free end is violently and irregularly swung because of the wind while proceeding forward through the air, and it sometimes strikes the user's throat, causing discomfort to the user.

There have been proposed various types of means of stopping the swinging (flapping) of the operational strap of chin straps. In one exemplary structure, even when the operational strap is not properly fastened by the fastening member of the retaining strap, the free end of the operational band is allowed to be connected to the operational strap itself.

For instance, such connecting means is comprised of a Velcro type fastener (other types may be, of course, employed) having a male member fixed at a base portion (or intermediate portion) of the operational strap itself which is allowed to be inserted simply through the fastening rings of the retainer strap and a female member fixed on the free end thereof. In this case, after being inserted through the fastening rings, the operational strap is passed through both the fastening rings, and is then folded to the surface of the base portion. Then, the female member of the Velcro type fastener placed at the free end of the operational strap is engaged with the male member of the Velcro type fastener positioned on the base portion of the operational strap itself.

However, in the above-mentioned structure, there occurs a possible problem due to troublesome of securing the operational strap properly through the fastening rings, or poor morals of some users, in that the operational strap is inserted through the two, or possibly only one of, the fastening rings in an improper order or manner, and is then folded to the surface of the base portion of the operational strap to be connected by the Velcro type fastener. In this case, it is assumed that the helmet will be detached from the user's head upon receiving a strong impact in an accident, incurring an unexpected danger.

SUMMARY OF THE INVENTION

Object of the Invention

It is an object of the present invention to porvide a helmet with a chin strap having a structure which may prevent swinging/flapping of its free end portion only when the strap is properly used.

It is another object of the present invention to provide a helmet with a chin strap which may call the user's attention to the proper use of the chin strap.

Other objects and features of the invention will be more fully understood from the following detailed description and appended claims when taken with the accompanying drawings.

DETAILED DESCRIPTION OF THE PREFERRED EMBODIMENTS

Figure 1:
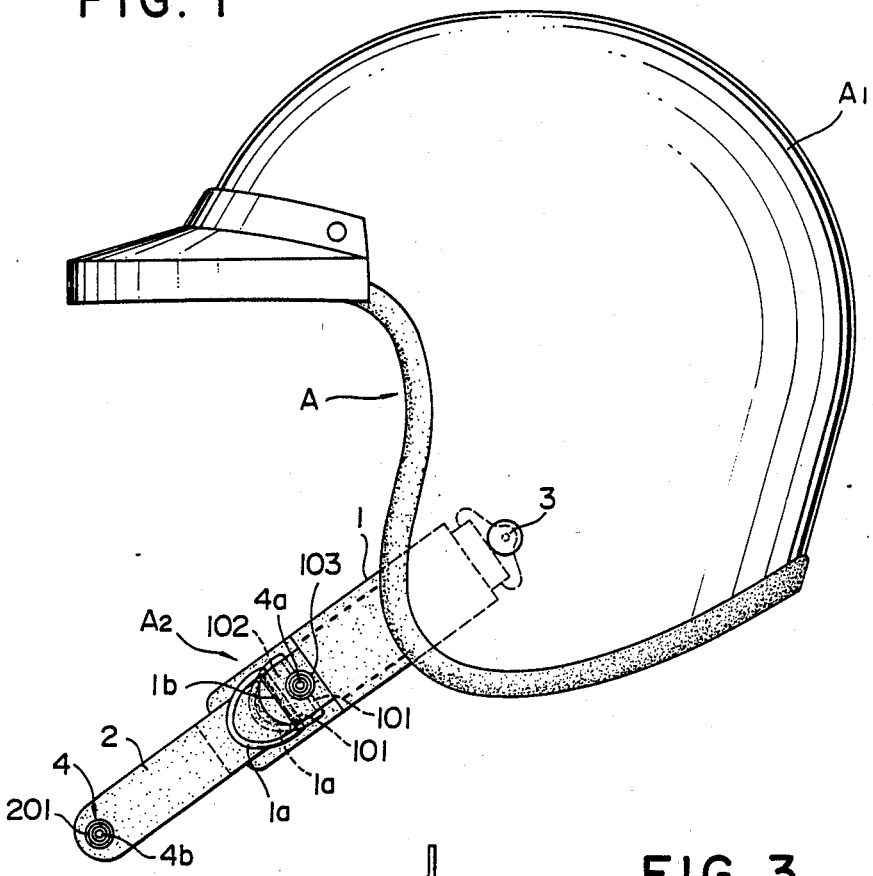
FIG. 1 is a side view of a preferred embodiment of the present invention.
Figure 2:
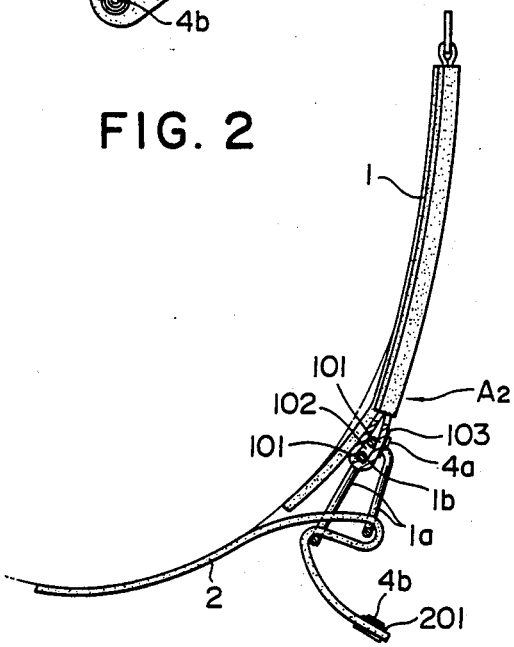
FIG. 2 is a front elevational view of the chin strap during a fastening operation thereof.
Figure 3:
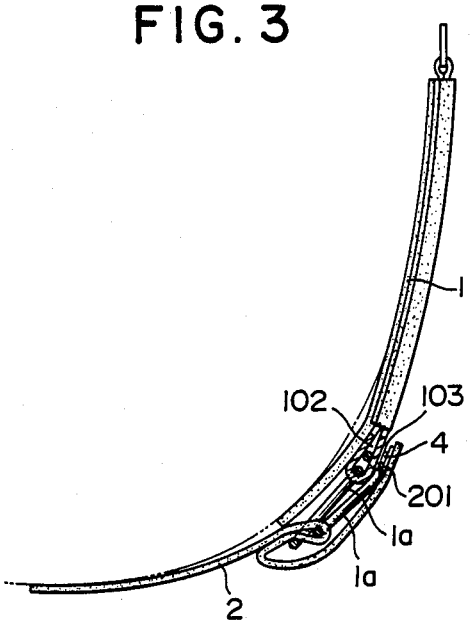
FIG. 3 is a front elevational view of the chin strap under the condition where the connector means are engaged with each other.

Referring to FIG. 1 to 3, reference symbol A generally designates a jet type helmet including a helmet body A1 formed of FRP, for example, and provided with a shock absorbing liner, a side cushion and a head cushion, etc. inside the helmet body A1. The helmet A is also provided with a chin strap A2 at both side portions of the helmet body A1.

The chin strap A2 is provided so as to fasten and support the helmet A to a user's head, and is formed like a strap formed of leather, synthetic leather, synthetic fiber and cloth, for example. The chin strap A2 comprises a pair of straps, that is, a retainer strap 1 and an operational strap 2, one end of both bands 1 and 2 being rotatably mounted through a pair of mount members 3 to both side portions of the helmet body A1 in an opposed relationship with one another.

The retainer strap 1 is provided at its free end with a pair of D-rings 1*a* as a fastener member, each of the D-rings 1*a* having a straight bar 101 about which the D-ring 1*a* is rotatable. The D-rings 1*a* are suspendedly supported to the retainer strap 1 in such a manner that the straight bars 101 are inserted into a support hole 102 of a support portion 1b formed by folding the retainer strap 1 outside.

A disk-like base plate 103 formed of a relatively hard material such as synthetic resin or metal is fixed on the outside surface of the support section 1*b*, and a male button 4*a* constituting a hook button 4 is fixed at the center of the base plate 103.

The operational band 2 is engaged and clamped slidably and detachably at its free end portion with the pair of D-rings 1*a* of the retainer strap 1. A disk-like base plate 201 is fixed on the inside surface (a surface to contact the user's skin) at the free end, and a female button 4*b* is fixed at the centre of the base plate 201. The female button 4b is detachably engaged with the male button 4a of the hook button 4.

Naturally, the male button 4 and the female button 4b may be alternated. That is, the male button 4a of the retainer strap 1 may be provided at the position of the female button 4b of the operational strap 2, and the female button 4b may be provided at the position of the male button 4a.

Figure 4:
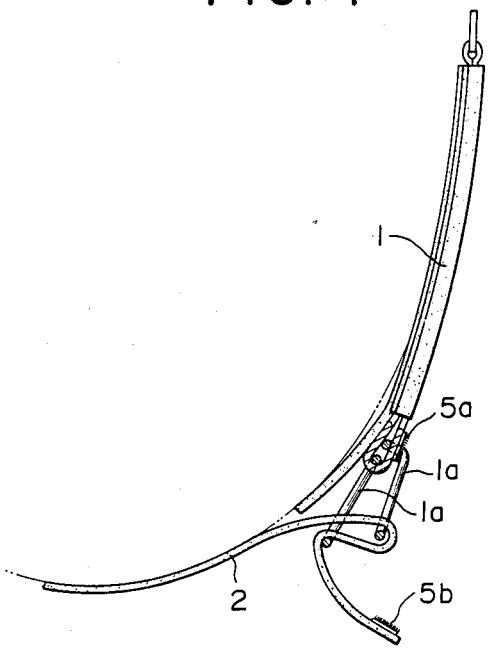
FIG. 4 is a front elevational view of the chin strap of another embodiment using a Velcro type fastener as the connector means.
Figure 5:
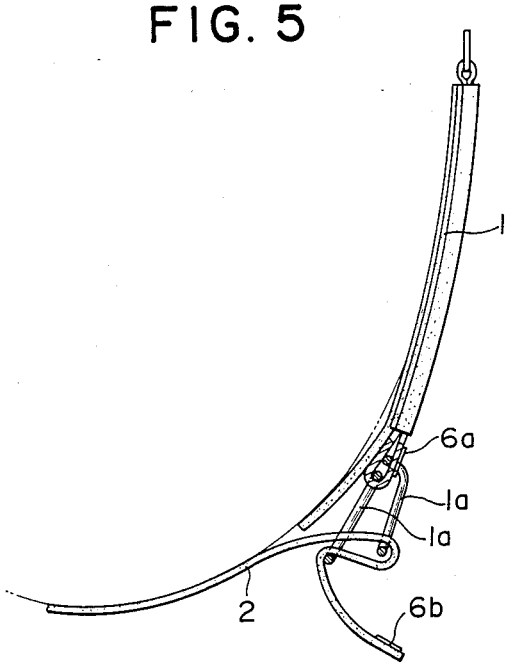
FIG. 5 is a front elevational view of the chin strap of a further modified embodiment using a magnet/magnets as the connector means

Further, means for stopping the free end portion of the operational strap 2 is not limited to the afore-mentioned hook button. For example, the connecting means may comprise Velcro type fasteners 5a and 5b as shown in FIG. 4, or magnets 6a and 6b as shown in FIG. 6.

There will be now described the operation of the chin strap A2 with the helmet A on.

As shown in FIGS. 2 and 3, after donning the helmet A, the free end portion of the operational strap 2 is inserted from the inside through both holes of the D-rings 1a to the outside, and is drawn upwardly. Then, the strap 2 is folded and passed between both curved bars of the D-rings 1a. Then, the strap 2 is stretched outwardly to fasten and secure the helmet A to the user's head.

Under the above condition, as the free end of the operational strap 2 is freely swingable, it is folded upward again, and the female button 4b povided at the free end is pushed to engage with the male button 4a of the retainer strap 1. Thus, the free end of the operational strap is fixed and prevented from swinging because of air flow during forward motion.

While the swinging of the free end portion of the operational strap 2 can be prevented by merely engaging the female button 4b of the operational strap 2 with the male button 4a of the retainer strap 1 without inserting the free end portion of the operational strap 2 through the D-rings 1a of the retainer strap 1, the operational strap will hang down away form the chin under the condition where chin strap A2 is not firmly fastened. Accordingly, the helmet A is not secured firmly to the user's head. Thus, a user's attention is indirectly called to the fact that the chin strap A2 is not properly engaged, and the user is demanded to properly fasten the strap.

EFFECT OF THE INVENTION

As is described above, one of the male or female connector means is provided on the skin contacting surface at the free end of the operational strap of the chin strap mounted to the helmet, and the mating connector means is fixed on the outside surface of the retainer strap. With this arrangement, the free end of the operational strap may be reliably prevented from swinging/flapping under the condition where the function of the chin strap is sufficiently exhibited.

Further, even when the user tries to fasten the operational strap by the said connector means only without normally inserting the operational strap through the fastening member of the retainer strap, the operational band cannot be secured snugly against the user's jaw/-throat, as is instracted and usual in practice, and said strap will hang loosely down from the chin. Accordingly, the user is indirectly demanded to properly use the chin strap.

What is claimed is:

1. A helmet comprising:

(a) a helmet body having first and second side portions;

(b) a chin strap including:

(i) a retainer strap having a first end mounted to the first side portion of the helmet body and a second, opposite free end having an outward surface;

(ii) a fastening member provided at the second end of the retainer strap, said fastening member including first and second rings pivotally connected at said second end;

(iii) an operational strap having a first end mounted to the second side portion of the helmet body and a second, opposite free end for insertion through and engaged with said first and second rings to secure said helmet body on a head of a user, said second free end of said operational strap extending in a direction away from said retainer strap when said operational strip is engaged with said rings and said second free end of said operational strap having a floppy nature and having an inner surface which may contact the user when said helmet body is positioned on the head of the user;

(iv) male connector means provided on the outward surface of the second free end of the retainer strap; and (v) female connector means for matingly connecting with the male connector means when said second free end of said operational strap is turned about said first ring in a direction extending toward said retainer strap to prevent free movement of the second free end of the operational strap, said female connector means provided on the inner surface of the second free end of the operation strap

2. A helmet according to claim 1; wherein said male connector means includes a snap button and said female connector means includes a snap receiver for snap fittingly receiving said snap button.

3. A helmet according to claim 1; wherein said male connector means includes a plurality of hook-like elements and said female connector means includes a material containing loops of thread for engagement by the hook-like elements.

4. A helmet according to claim 1; wherein one of said male connector means and said female connector means includes a magnetic material and the other of said male connector means and said female connector means includes a magnetically attractable material.

* * * * *